United States Patent [19]

Grube

[11] 4,282,771

[45] Aug. 11, 1981

[54] RAILROAD HAND BRAKE WITH SPRING CLUTCH

[75] Inventor: William L. Grube, Lake Bluff, Ill.

[73] Assignee: MacLean-Fogg Company, Mundelein, Ill.

[21] Appl. No.: 849,777

[22] Filed: Nov. 9, 1977

[51] Int. Cl.[3] ..... G05G 1/08; F16D 67/02

[52] U.S. Cl. ..... 74/505; 192/12 BA

[58] Field of Search ..... 74/505; 192/12 BA, 12 B, 192/15

[56] References Cited

U.S. PATENT DOCUMENTS

| | | | |
|---|---|---|---|
| 307,663 | 11/1884 | Lane | 192/8 |
| 1,505,350 | 8/1924 | Johnson et al. | 74/508 |
| 1,890,973 | 12/1932 | Drexler et al. | 192/4 |
| 1,953,370 | 4/1934 | Starkey | 192/41 |
| 2,038,063 | 4/1936 | Starkey | 192/41 |
| 2,621,541 | 12/1952 | Rath | 74/626 |
| 3,040,597 | 6/1962 | Bretz, Jr. | 192/15 |
| 3,087,587 | 4/1963 | Flieg | 192/12 BA |
| 3,451,512 | 6/1969 | Sacchini et al. | 192/12 BA |
| 3,797,618 | 3/1974 | Peterson et al. | 192/12 BA |
| 4,059,176 | 11/1977 | Lowery et al. | 192/12 BA |

*Primary Examiner*—Kenneth Dorner

*Attorney, Agent, or Firm*—Mason, Kolehmainen, Rathburn & Wyss

[57] ABSTRACT

A railroad hand brake includes a spring clutch interposed between an operating hand wheel and a gear drive for the chain drum. The clutch includes a spring cooperating with a control drum and with an output drum connected to the gear drive. An input element is rotated by the hand wheel in a forward direction to energize the spring so that the input element, the control drum and the output drum rotate as a unit to take up the brake load. A ratchet and pawl prevent reverse movement of the control drum in order to maintain the brake load applied when the hand wheel is released. When the hand wheel is rotated in the reverse direction, the input element tends to deenergize the spring, and the brake load is gradually released with a clutch action characterized by small input force and little wear. A quick release element operable with a small manual force abruptly uncouples the spring from the load drum in order to free the load quickly while the input element and hand wheel are stationary.

27 Claims, 16 Drawing Figures

FIG. 3
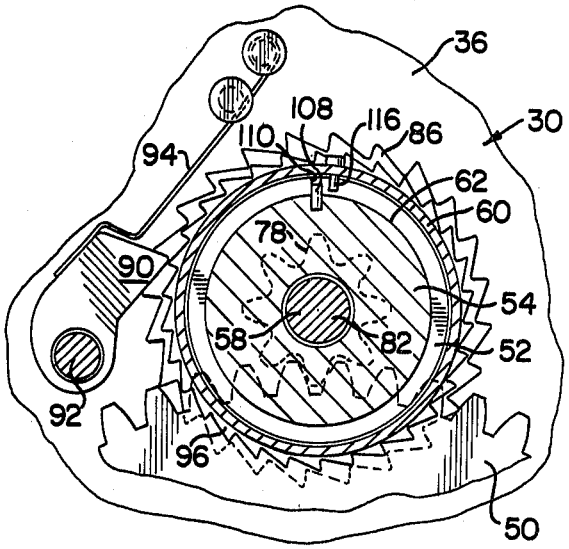
FIG. 5
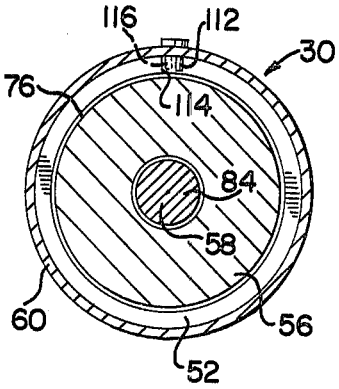
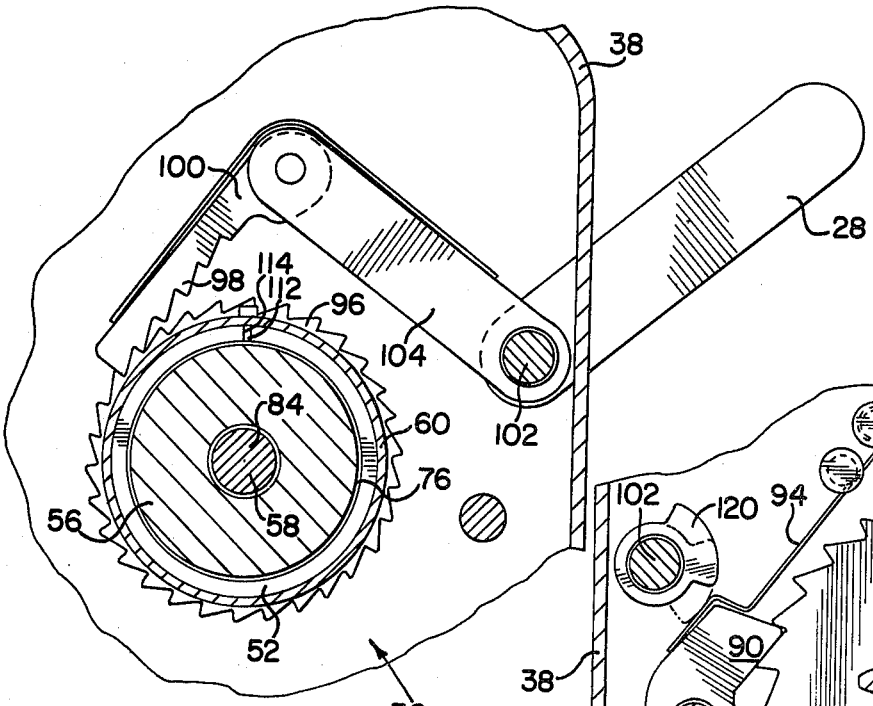
FIG. 4
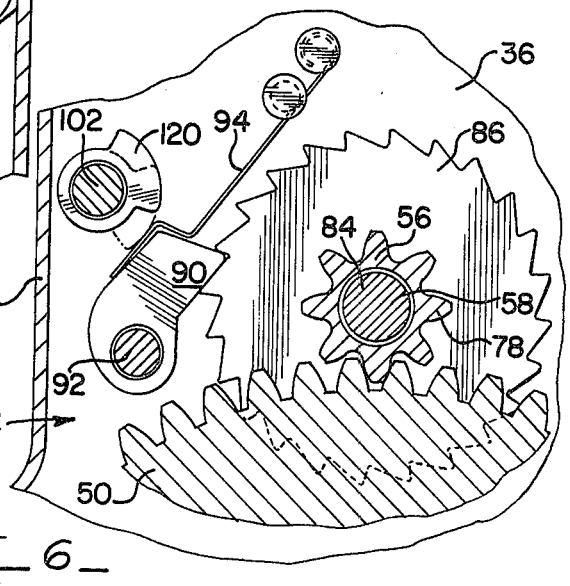
FIG. 6

RAILROAD HAND BRAKE WITH SPRING CLUTCH

The present invention relates to improvements applicable to railroad hand brakes and similar load take up devices, and to improved spring clutch mechanisms useful in such devices.

A typical railroad hand brake is a chain hoist load take up mechanism mounted on a railroad car and coupled to the brake rigging of the car for manual control of the car brake system when the system is uncoupled from the pneumatic circuit of a train. The hand brake in common use today includes a rotating hand wheel coupled to a gear driven chain drum by a mechanism, known as a Weston clutch or Weston automatic brake, including screw-actuated clutch discs. The brake is applied by turning the hand wheel in a forward direction, and the screw thread frictionally locks the discs together so that the chain drum is rotated and the chain is taken up. Chain tension is applied to the car brake rigging to apply the car brakes. When the hand wheel is released, the car brakes are maintained in the applied condition because the chain load is applied to a loaded clutch disc engaging an intermediate disc held against rotation in the reverse direction, typically by a pawl and ratchet.

The brake can be released gradually by rotating the hand wheel in the reverse direction to tend to unscrew the screw thread and separate the discs, thereby permitting the loaded disc to follow the rotation of the hand wheel. For quick release of the brakes, there is typically provided a separate manually operated lever. Operation of this lever is effective to uncouple the chain drum from the clutch mechanism, for example by disengaging the gear drive or otherwise. The uncoupled chain drum is then free to rotate, and the load is abruptly released.

This typical Weston clutch railroad hand brake has some undesirable features. One undesirable feature is that the force required to release the brake can be very substantial because the brake release force is of a magnitude comparable to the force with which the brakes are applied. Thus, if the hand brake is over-torqued, or if the hand brake is applied after the brake rigging has been operated by a train pneumatic system, the reactive load applied to the clutch mechanism can be substantial. The hand wheel must be turned against the friction load on the clutch discs.

This difficulty applies not only to gradual release through reverse rotation of the hand wheel but also to quick release. When the clutch and gear drive are under substantial loads imposed by chain tension upon the chain drum, the manual force required for uncoupling of the drive for quick release can be undesirably large.

Another disadvantage of the typical Weston clutch hand brake system is that due to the large forces required for its operation, wear in the system can be undesirably rapid. Because large input forces or operating forces are required in the release of brake loads, the clutch surfaces in known devices are subject to overheating and rapid deterioration. This problem becomes particularly evident in cycle testing at large loads.

It is an important object of the present invention to provide improvements in railroad hand brakes and similar load take up devices making possible the control of large loads with small input or operating forces. It is another object of the invention to provide railroad hand brakes or similar load take up devices wherein the problem of wear occasioned by the release of large loads is greatly reduced. Other objects are to provide railroad hand brakes having a desirable and positive operator feel; and to provide railroad hand brakes capable of overcoming the disadvantages of hand brakes used in the past.

Spring clutches have enjoyed wide use in the past as load transmission devices such as clutches or brakes. Generally, they have taken two basic forms. One is an overrunning clutch wherein an input shaft or drum is coupled by a clutch spring to an output shaft or drum to provide a unidirectional drive permitting overrunning of the output drum. In another configuration, a load bearing shaft or drum is coupled by a spring to a fixed support so that the load is transferred to the support. This configuration typically provides a so-called no-back brake function, and permits gradual release of the load with a clutch action.

Although these basic functions have been employed in various combinations, heretofore there has not been provided a spring clutch assembly capable of providing the diverse operating features desired in a railroad hand brake or similar device. In particular, known spring clutch assemblies are not capable of providing all of the necessary functions of load application, maintaining the load applied, gradual or modulated release and quick release in one simple and reliable structure.

Additional objects of the present invention are to provide a load take up device such as a railroad hand brake incorporating a spring clutch mechanism; to provide improved spring clutch mechanisms capable in reliable and simple fashion of carrying out the various functions required of a railroad hand brake or similar load take up device; and to provide improvements in spring clutches.

In brief, in accordance with the above and other objects of the present invention, there is provided an improved load take up device or railroad hand brake including a housing, a hand wheel, and a chain drum rotated under the control of the hand wheel for operation of a railroad car brake rigging system. In accordance with one important feature of the present invention, an improved spring clutch is coupled between the hand wheel and a gear drive for the chain drum.

The improved spring clutch of the present invention includes an output drum having a cylindrical surface coupled to the chain drum or other load. A control drum has a cylindrical surface adjacent to and aligned with the output drum. The output and control drums are mounted for rotation relative to the housing about a common axis. A rotation controlling mechanism such as a pawl and ratchet is connected between the housing and control drum and limits the rotation of the control drum to a single direction.

A coil spring is telescoped with the output and control drums and is radially deformable in opposite directions selectively to engage or release the output and control drums. An input element operable by the hand wheel engages the spring at a region adjacent the control drum and remote from the output drum. The input element is movable in a forward direction to deform or energize the spring so that it interlocks the input element, the control drum and the cutput drum for rotation in forward direction for load take up. The input element is rotated in the reverse direction to deform or deenergize the spring to tend to release the output and control drums thereby to permit gradual movement of the output drum for gradual release of the load.

A quick release element is engageable with the spring at a region adjacent the output drum and remote from the control drum. The quick release element is manually operated to tend to radially deform the spring abruptly to uncouple the output drum from the control drum.

Energization and deenergization of the clutch spring may be accomplished with applied forces only a small fraction of the load forces being controlled. Consequently, operation of the load take up device or hand brake, even when controlling heavy loads, is effected with small forces. Moreover, since the device is characterized by small operating forces, the problem of clutch wear is greatly reduced.

The invention together with the above and other objects and advantages thereof may be best understood from the following detailed description of the embodiments of the invention illustrated in the drawings, wherein:

FIG. 3 is a fragmentary sectional view on an enlarged scale taken along the line 3—3 of FIG. 2;

FIG. 4 is a fragmentary sectional view on an enlarged scale taken along the line 4—4 of FIG. 2;

FIG. 5 is a partial sectional view similar to a portion of FIG. 4;

FIG. 6 is a fragmentary sectional view taken along the line 6—6 of FIG. 2;

Figure 2:
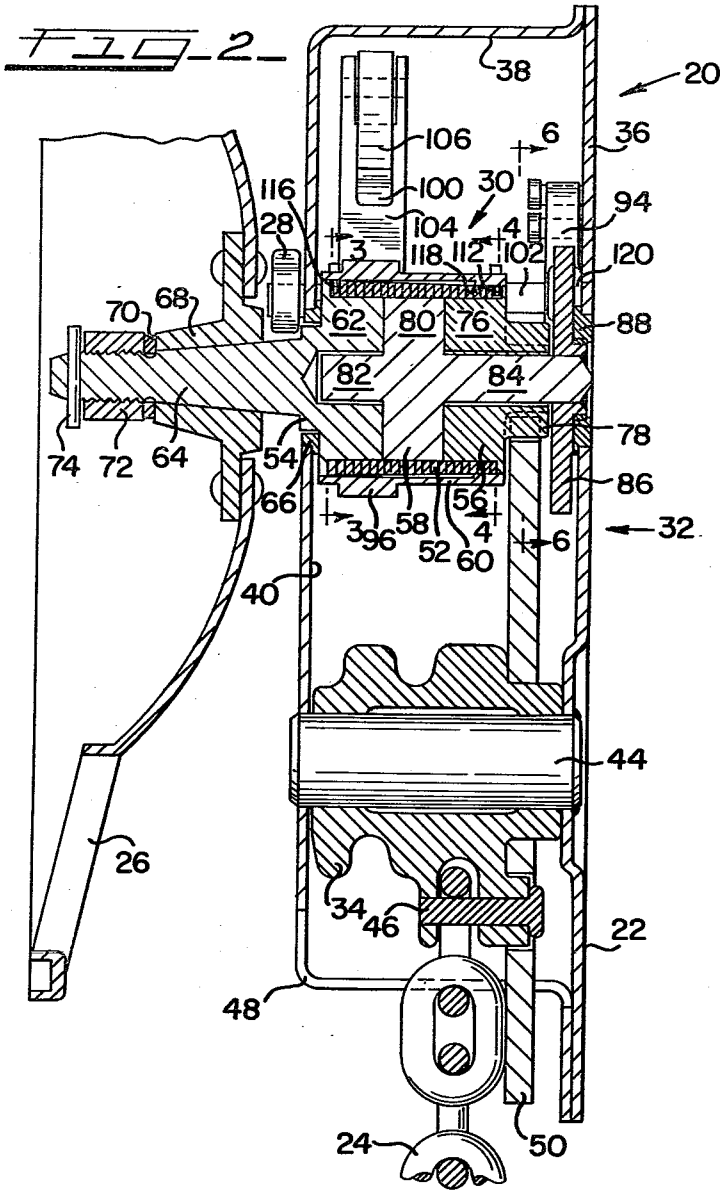
FIG. 2 is a sectional view of the hand brake of FIG. 1 taken along the line 2—2 of FIG. 1.

Having reference now to the drawings, and initially to FIGS. 1–6, there is illustrated a railroad hand brake designated as a whole by the reference numeral 20 and constructed in accordance with the principles of the present invention. In general and referring first to FIGS. 1 and 2, the hand brake 20 includes a housing 22 adapted to be supported on a railroad car and from which descends a chain 24 adapted to be connected to the brake rigging of the car to the end that when the chain 24 is raised, the car brakes are applied and when the chain 24 is lowered, the car brakes are released. While the present invention is illustrated in connection with railroad hand brakes including the hand brake 20, it should be understood that the principles of the invention are applicable to other types of chain hoist and load take up devices.

Raising and lowering of chain 24 for application and release of the car brakes is effected by the rotation of a hand wheel 26. Abrupt release of the brakes may be effected by manual lifting of a quick release lever 28.

In accordance with an important feature of the invention, the hand brake 20 is provided with a spring clutch assembly generally designated as 30. The spring clutch assembly is interposed between the hand wheel 26 and a drive gear system generally designated as 32 for controlling the rotation of a chain drum 34 upon which the chain 24 may be wound. As appears in more detail hereafter, the spring clutch 30 of the present invention permits the chain load to be applied and maintained in applied condition, and to be gradually or abruptly released with the application of small operating or input forces and with little wear.

Proceeding now to a more detailed description of the construction of the hand brake 20, the housing 22 includes a back plate 36 and a cover 38 having flanges overlying the back plate 36 and defining an internal cavity 40 within which are mounted most of the components of the hand brake 20. Mounting holes 42 are provided for attaching the housing 22 to the structure of a railroad car with the hand wheel 26 in an accessible location and with the chain 24 extending downwardly for attachment to the brake rigging.

In order to permit rotation of the chain drum 34, it is carried on a spindle 44 supported between the back plate 36 and cover 38. The chain 24 is attached to the drum 34 by a pin 46, and chain 24 descends through an opening 48 provided in the housing 22. A gear 50 concentric with spindle 44 is attached to the drum 34.

The spring clutch assembly 30 provided in accordance with the present invention includes a coiled clutch spring 52 associated with an input element 54, an output element 56, a control element 58 and a quick release element 60. The assembly 30 serves in novel fashion to control the take up and release of the load or chain 24 under the control of the rotation of hand wheel 26 and movement of lever 28.

More specifically, the input element 54 includes a circular cylindrical drum portion 62 adjacent the outer segment of clutch spring 52 from which extends an input shaft portion 64. The input element is journalled for rotation in the housing cover 38 by a bushing 66, and the hub 68 of the hand wheel 26 is attached to the shaft 64 by a washer 70, nut 72, and pin 74.

Output element 56 includes a drum portion 76 associated with the inner segment of clutch spring 52. A pinion gear 78 extends from the drum 76 and is engaged with the chain drum gear 50.

The control element 58 includes a drum portion 80 associated with the central segment of the clutch spring 52 and interposed in alignment between the input drum 62 and the output drum 76. A stub shaft portion 82 of the control element 58 extends into a recess in the input element 54. A rearwardly extending shaft 84 of the control element extends through a central axial opening in the output element 56 and is attached to a ratchet gear 86 journalled for rotation in the housing back plate 36 by a bushing 88.

In order to limit rotation of the control element 58 to a single direction, a pawl 90 engages the ratchet gear 86. Pawl 90 is pivotally mounted upon a pin 92 carried by the housing back plate 36 and is urged into engagement with the ratchet gear 86 by means of a spring 94.

The input, output and control drums 62, 76 and 80 are aligned with one another and rotatable about a common axis of rotation coinciding with that of the hand wheel 26, the pinion 78 and the ratchet gear 86. The drums lie in a common surface of rotation, preferably a right circular cylindrical surface as illustrated. The clutch spring 52 overlies all of these three drum surfaces for selective engagement therewith.

The quick release element 60 comprises a hollow drum or collar member overlying the outer surface of the clutch spring 52. In this manner the clutch spring is telescoped between the outer common surface of the drums 62, 76 and 80 and the inner surface of the quick release element 60. The outer surface of the quick release element 60 is provided with a circular array of gear teeth 96. This permits the quick release element 60 to be rotated by cooperating ratchet teeth 98 formed on a release arm 100.

Figure 1:
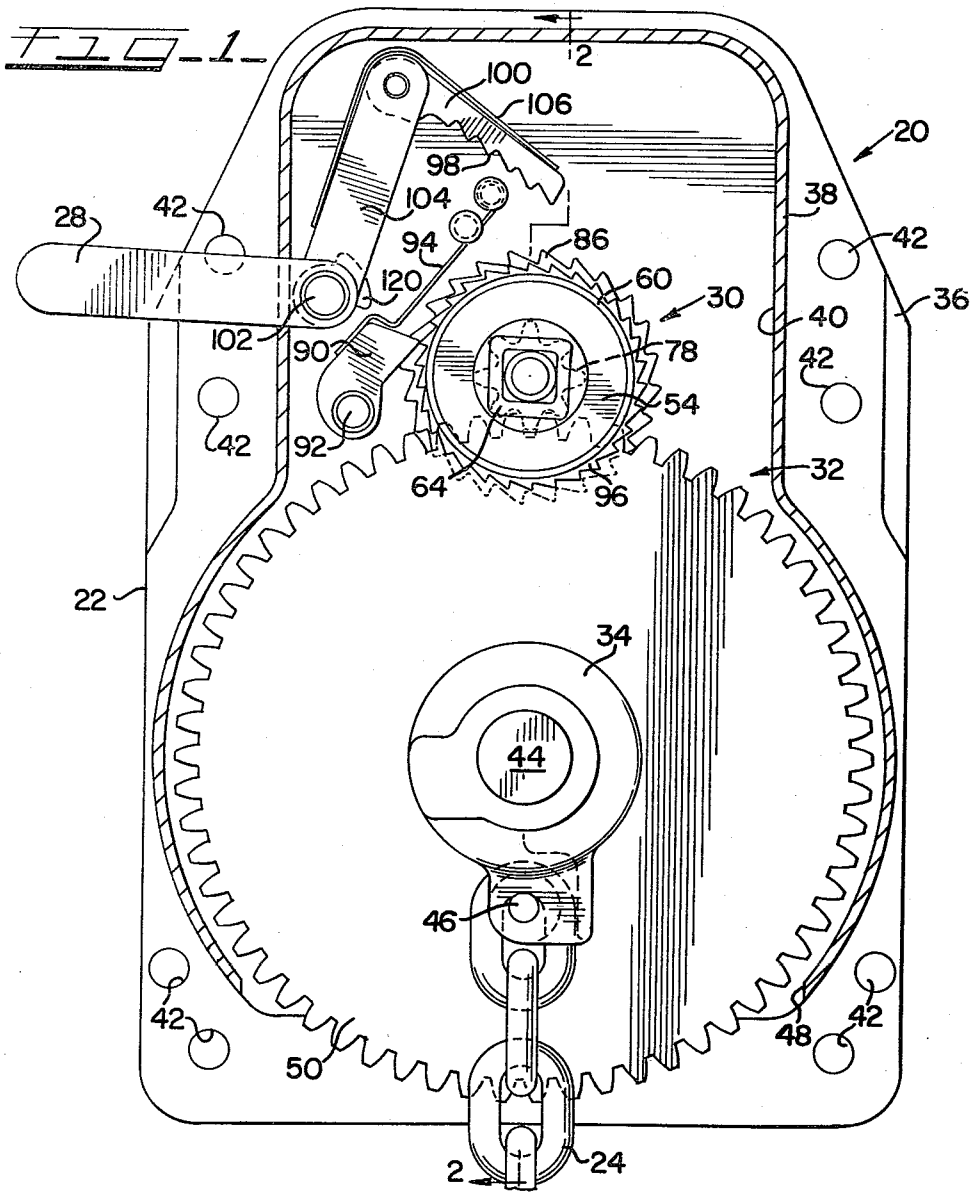
FIG. 1 is a front view of a railroad hand brake constructed in accordance with the invention, with the hand wheel omitted and the housing shown partly in section.

In the position illustrated in FIG. 1, the release arm 100 is spaced from the quick release element 60 and does not interfere with its rotation. When the quick release lever 28 is raised, it rotates about a quick release shaft 102 extending between back plate 36 and cover 38 causing simultaneous rotation of a carrier arm 104 fixed to the lever 28. The release arm 100 is mounted for limited pivotal movement upon the opposite end of the carrier arm 104 and a leaf spring 106 holds the arms 104 and 100 in the normal position illustrated in FIG. 1. When the quick release lever 28 is pivoted as illustrated in FIG. 4, the teeth 98 engage the teeth 96 on the quick release element 60 producing limited rotation of the quick release element 60 while the arm 100 pivots with respect to the arm 104.

When it is desired to apply the brakes by winding the chain 26 upon the chain drum 34, the hand wheel 26 is rotated in the clockwise direction in the orientation illustrated in FIG. 1. For convenience in description, this rotational, load take up direction is referred to herein as the "forward" direction, while the opposite rotational direction is referred to herein as the "reverse" direction. Forward rotation of the hand wheel 26 results in simultaneous forward rotation of the pinion 78 thus rotating the gear 50 and chain drum 34 in the direction for taking up the chain 24.

Clutch spring 52 has a normal, relaxed diameter slightly less than that of the drums 62, 76 and 80. As a result, after assembly, the spring 52 is in frictional engagement with the drum surfaces and cooperates therewith to form a self-energizing, contracting spring clutch. When the input drum 62 is rotated in the forward direction, the spring 52 tends to tighten itself firmly about not only the input drum 62 but also the output drum 76 and the control drum 80. Thus, all of these three drum elements are locked together by the spring 52 and rotate in the forward direction in a substantially unitary fashion.

During rotation of the drum members, the ratchet gear 86 also rotates in the forward direction. Rotation in this direction is permitted by the pawl 90.

When the brakes have been applied by winding the chain 24 against the brake load to a desired extent, the hand wheel 26 is released and the brakes remain locked. The control element 58 is held against rotation in the reverse direction by means of the pawl 90. The chain tension or brake load force acts on the pinion 78 through the agency of gear 50 urging the pinion 78 and output drum 76 to rotate in the reverse direction. As a result, the portion of the clutch spring 52 overlying the output drum 76 and the control drum 80 is maintained in firm, locking engagement with these drums. Since the pinion 78 is therefore prevented from rotating in the reverse direction, the brakes are maintained in the applied condition.

In order gradually to release the brakes by permitting unwinding of the chain 24, the hand wheel 26 is turned in the reverse direction. The input element 54 includes a drive member in the form of a drive pin 108 extending radially outwardly from the surface of the input drum 62. As best illustrated in FIG. 3, the drive pin 108 is in alignment with an outer radial end 110 of the spring 52. As input element 54 is rotated in the reverse direction, the pin 108 pushes against the spring end 110 causing the spring 52 to tend to radially expand and to separate itself from the surfaces of the input drum 62, the control drum 80 and the output drum 76.

The result of this radial expansion of deenergization is to permit the pinion 78 gradually to rotate in the reverse direction under the influence of the applied reactive load. Radial expansion or deenergization of the spring due to drive pin 108 is effective starting at the outer end 110 of the spring and moving toward its opposite end. As the spring 52 becomes disengaged from the control drum 80, the output drum 76 moves in the reverse direction tending once again to tighten the spring. In this manner, the output drum 76 is able through clutching action of the spring 52 to follow the rotational reverse movement of the input drum 62 while the control drum 80 remains stationary.

One important advantage of the spring clutch assembly 30 is that the force required to release the brake is small. Even if the brake load is large, such as may result from overtorquing or from simultaneous application of the brakes manually after pneumatic actuation, nevertheless the force required for gradual release of the brakes is only that necessary for radial expansion or deenergization of the clutch spring 52. This force is only a small fraction of the load to which the output drum 76 may be subjected. Wear of the clutch elements is minimal because large operating or input forces need not be dissipated at the clutching surfaces.

In some instances it is desirable to release the brake forces or load quickly, rather than in a gradual or modulated fashion. In order to effect this load dump or quick release operation, the quick release lever 28 is pivoted upwardly thereby to rotate the quick release element 60 in the forward direction through the agency of the release arm 100. As best illustrated in FIG. 4, the quick release element 60 is provided with a drive element taking the form of a radially extending pin 112 aligned with the inner radial end 114 of the spring 52. As the quick release element 60 is rotated, the pin 112 engages the end 114 of the spring 52, causing the innermost portion of the spring to tend to radially expand or become deenergized. As a result, the output drum 76 is freed from the stationary control drum 80 and is capable of rotation independently of the control drum. Consequently, the chain is free to descend under the influence of the applied load. This quick release is accomplished while the input element 54 and the hand wheel 26 remain stationary.

Because only a relatively small force is required for radial expansion or deenergization of the spring 52 by the quick release element 60, the quick release action is obtained with only a small applied manual force. This is true even if the spring clutch assembly 30 is subjected to a large load at the time of quick release. Since large input forces are not required for quick release, wear of the clutch surfaces is avoided.

As can be seen from FIGS. 2, 3 and 5, the quick release element 60 is provided with a second pin 116 located adjacent the drive pin 108 and the outer end 110 of the spring 52. The function of the pin 116 is, in cooperation with the drive pin 102, to assure that the quick release element 60 is maintained in rotational alignment with the clutch spring 52.

More specifically, during brake application when the input drum 62 is rotated in the forward direction, the drive pin 108 engages the pin 116 at the outer end of the quick release element 60 causing element 60 to rotate simultaneously in the forward direction. Consequently, because both the spring 52 and quick release element rotate, the quick release pin 112 is maintained adjacent the inner spring end 114 (FIG. 5). Conversely, during gradual release, the spring is rotated in the reverse direction by engagement of the drive pin 108 against the outer spring end 110. The inner spring end engages the quick release pin 112 simultaneously to rotate the quick release drum thus to maintain the pin 116 adjacent the pin 108 and the outer spring end 110.

This arrangement assures that limited forward rotation of the quick release element 60 consistently results in engagement of quick release pin 112 against the inner spring end 114. Also, binding of the pins against the outer spring coils is precluded. Preferably a small clearance of perhaps a few degrees is provided between the pins and the spring ends.

In order to obtain reliable clutch operation, it is preferred that the clutch spring 52 be uniformly tapered throughout its length with the turns at the outer end having a thickness slightly greater than those at the inner end. This taper is shown in exaggerated fashion in FIG. 2 of the drawings. This construction permits reliable radial deformation of the spring during quick release by assuring orderly progressive expansion or deenergization of the turns of the spring. This construction also avoids inconsistent operation and chatter during gradual release.

An additional advantage of the spring clutch arrangement 30 is that the clutch spring 52 is captured between the surfaces of drums 62, 76 and 80 and the inner surface of the quick release element 60. In this manner, the non-working surface of the spring 52 is supported against excessive radial deformation. As can be seen in FIG. 5, the inner surface of the quick release element 60 can be stepped as indicated at 118 in order closely to surround the inner end portion of the spring 52 so that the spring is closely supported at the region which is subject to deformation during quick release operation.

At the initiation of quick release, the load applied to the pinion 78 holds the clutch spring 52 tightly in engagement with the output drum 76 and control 80. However, in some circumstances it may be desirable to operate the quick release lever 28 with a very small load applied to the output drum 76. In this instance, there might be a tendency for rotation of the quick release element 60 not to deenergize the spring 52, but rather to rotate the entire spring 52 together with the drums 80, 62 and 76.

In order to assure that the control drum 80 remains stationary during quick release operation, a cam 120 is mounted upon the quick release shaft 102 for movement together with the quick release lever 28. When the lever 28 is pivoted, the cam 120 engages the pawl 90 as shown in broken lines in FIG. 6 to hold the pawl in engagement with the ratchet gear 86.

Having reference now to FIGS. 7–11, there is illustrated a spring clutch hand brake designated generally as 130 and comprising an alternative embodiment of the present invention. The hand brake 130 is similar in many respects to the hand brake 20 illustrated in FIGS. 1–6 and described above in detail. Consequently, the hand brake 130 is not illustrated and described in detail in its entirety. Similar reference numerals are used for designation of elements of the hand brake 130 which are similar to the corresponding elements of the hand brake 20.

In accordance with one feature of the invention, the hand brake 130 is provided with a back drive capability for positively unwinding chain 24 even when the load or reaction torque applied to the pinion 78 is negative, or in the reverse direction. This feature may be desirable if, for example, resistance to complete chain unwinding results from excessive friction, dirt, damage to components of the hand brake or the like.

More specifically, in accordance with the invention there is provided a unidirectional drive connection generally designated as 132 (FIG. 11) coupled between the quick release element 60 and the output element 56. The connection 132, illustrated in FIG. 11 of the drawings, permits the output element 56 to rotate in the reverse direction relative to the quick release element 60 but prevents relative rotation in the opposite direction.

In the illustrated arrangement, the drive connection 132 includes a drive finger 134 resiliently urged in a radially inward direction from the quick release drum 60 into a notch 136 formed in the output drum 76 of the output element 56. The notch 136 includes a radial drive surface 138 on one side of the drive finger 134, and a cam surface 140 on the opposite side of the finger 134.

The drive finger 134 comprises an end portion of a generally circular spring 142 having its opposite end 144 captured in a retaining hole in the quick release element 60. The resilience of the spring 142 biases the drive finger 134 into notch 136 to the end that reverse rotation of the quick release element 60 results in simultaneous reverse rotation of the output drum 76 due to engagement of the drive finger 134 with the drive surface 138. However, reverse rotation of the output drum 76 relative to the quick release element 60 is permitted because when the drive finger 134 enters the notch 136, it is moved up out of the notch by the cam surface 140.

During gradual release operation of the hand brake 130, resistance to complete unwinding of the chain may be encountered. For example, the chain drum 34 may bind upon the spindle 44, the housing may be damaged to interfere with the chain drum 34 or gear 50, or for many other reasons resulting from rough treatment or environmental conditions.

Under such conditions during gradual release, the operation of the hand brake 130 is identical to that of the hand brake 20 described previously until resistance to further unwinding of the chain is encountered. When the resistance exceeds the available overriding torque of the clutch spring 52, the clutch spring tends to rotate over the output drum 76 while the output drum remains stationary. Due to the engagement of the inner spring end 114 against the quick release pin 112, the quick release element 60 also tends to rotate around the stationary output element 56. This relative rotation occurs only until the drive finger 134 reaches the notch 136.

At this time, the finger 134 enters the notch 136 and engages the drive surface 138. Consequently, the output element is positively driven by the drive connection 132 in the direction for effecting unwinding of the chain despite resistance.

As indicated above, the quick release element 60 comprises a drum having a cylindrical inner surface closely surrounding the outer surface of the clutch spring 52. If resistance to rotation of the output element in the chain unwinding direction is sufficiently great, the spring 52 tends radially to expand into tight frictional engagement with the inner surface of the quick release drum 60. Consequently, back driving may be effected by a direct drive connection between the spring 52 and the quick release drum 60.

The unidirectional drive connection 132 does not interfere with quick release rotation of the output drum 76 relative to the stationary quick release element 60. Upon quick release when the output drum 76 can spin through several revolutions, the drive finger 134 simply snaps past the notch 136. Each time the drive finger 134 enters the notch 136, it is resiliently moved radially outwardly by the cam surface 140.

In accordance with another feature of the invention, the hand brake 130 is provided with a pawl release structure generally designated as 150 for permitting bidirectional rotation of the control drum 80 under conditions of little or no load. This arrangement has the advantage that unwinding of the chain may be accomplished without application of the input force required for overcoming the overriding torque of the clutch spring 52, and the hand wheel 26 may be spun freely to unwind slack chain.

More specifically, as illustrated in FIGS. 7–10, the hand brake 130 is provided with a pivot plate 152 supported for pivotal rotation about a pin 154 extending between the back plate 36 and cover 38. A pawl 156 engageable with the ratchet gear 86 is also pivotally mounted upon the pin 154.

The bushing 88 within which the output element 56 is rotatably mounted is carried by the pivot plate 152 rather than by the back plate 36. The bushing 66 (FIG. 9) carried in the housing cover 38 supports the input element 54 somewhat loosely so that the spring clutch assembly 30 is somewhat pivotable or tiltable about the bushing 66. As a result, the pivot plate 52 is able to move between the position illustrated in FIG. 7 and the position illustrated in FIG. 8. The position illustrated in FIG. 7, which might be termed a normal or loaded position, is determined by engagement of the plate 152 against a stop 158 supported on the back plate 36. The position of FIG. 8, which may be termed an unloaded position, is defined by engagement of the pivot plate 152 against a portion of the housing cover 38.

Figures 7, 8, 9, 10, 11:
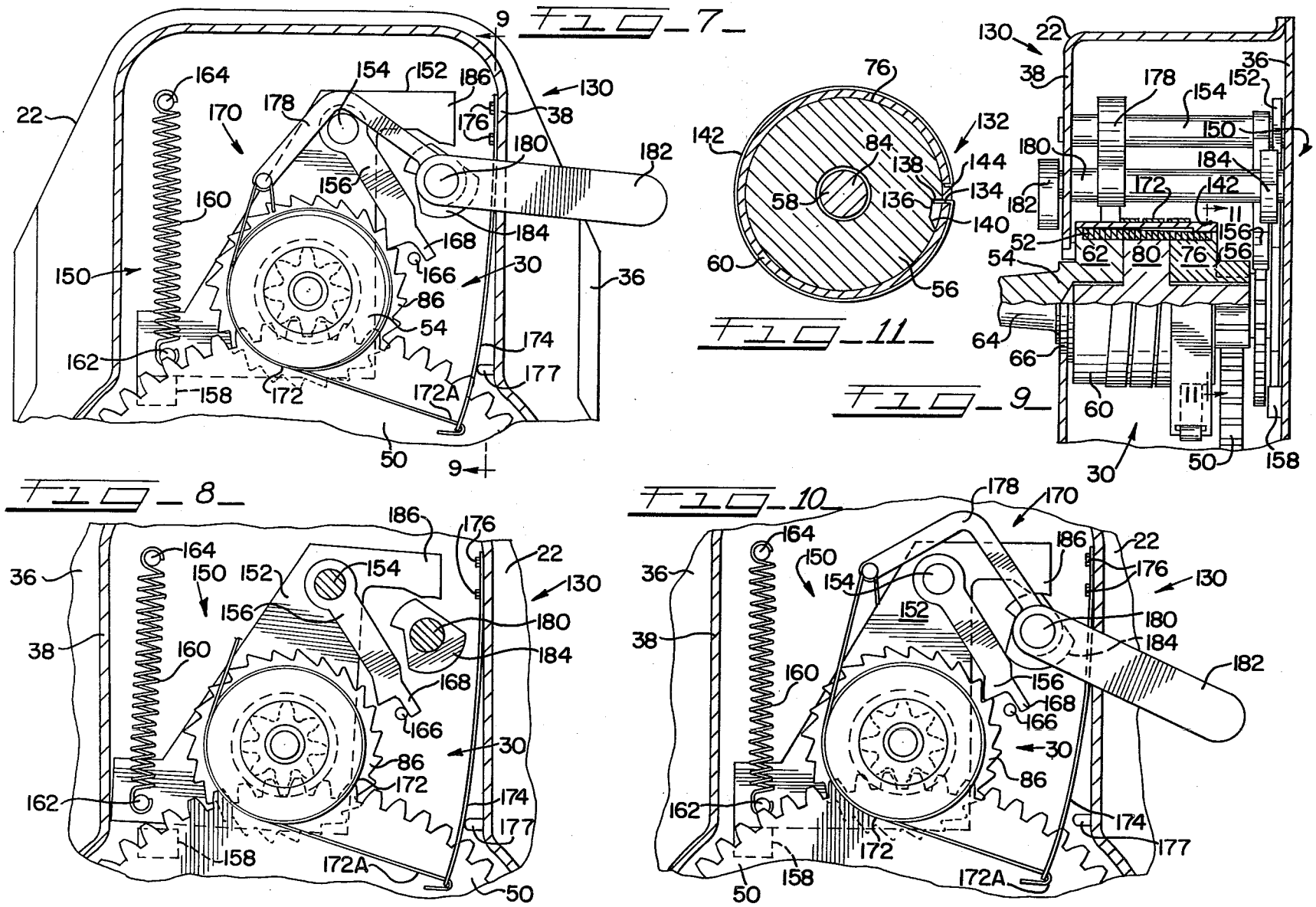
FIG. 7 is a partial front view, partly in section, of a railroad hand brake comprising an alternative embodiment of the present invention.
FIG. 8 is a view similar to a portion of FIG. 7 illustrating components of the structure in a different position.
FIG. 9 is a sectional view taken along the line 9—9 of FIG. 7 with a portion of the spring clutch assembly also shown in section.
FIG. 10 is a view similar to FIG. 7 illustrating components of the device in a different position.
FIG. 11 is a sectional view taken along the line 11—11 of FIG. 9.

Under operating conditions in normal loading, a reaction force is applied by the gear 50 to the pinion 78 tending to pivot the plate 152 to the position of FIG. 7 against the stop 158. However, when little or no load is present, the plate 152 is pivoted to its alternate FIG. 8 position by means of a spring 160 supported in tension between a pin 162 on the plate 152 and a pin 164 mounted on the back plate 36.

During gradual release of a load as the hand wheel and input element 54 are rotated in the reverse direction, the control drum 80 is held stationary by its engagement with pawl 156. The clutch spring 52 is rotated by the drive pin 108 on the input drum 62, and slips around the stationary control drum 80. When little or no loading is present to urge the output element 76 in the reverse direction, an input force of a few pounds would still be required to force the spring 52 to slip over the stationary control drum 80.

In order to avoid the necessity for even this small force under conditions of little or no load, the pawl release structure 150 is provided. When the load diminishes to a predetermined small amount, the spring 160 pivots the plate 152 to the position illustrated in FIG. 8. A pawl stop pin 166 mounted on back plate 36 is engaged by a pawl extension 168 on the pawl 156 to prevent simultaneous movement of the pawl. Consequently, the ratchet gear 86 moves clear of the pawl 156, thus freeing the ratchet gear 86 and the control drum 80 for free movement in both directions.

Since under conditions of little or no load the control drum 80 is freely movable in the reverse direction, it is not necessary for hand wheel force to be provided to cause the spring 52 to move around the control drum. Rather, the control drum moves together with the spring 52, the input drum 62 and the output drum 76 freely in the reverse direction. As a consequence, the spring clutch assembly 30 provides no resistance to continued unwinding of the chain 24.

Another feature of the present invention resides in the provision of a novel quick release operator mechanism generally designated as 170 with which the hand brake 130 is equipped. The mechanism 170 is capable of reliably producing forward rotation of the quick release element 60 in a simple and straightforward fashion and regardless of the presence of dirt, oil or the like within the housing 22.

More specifically, the outer surface of the quick release element 60 of hand brake 130 comprises a circular cylindrical drum surface, the quick release teeth 96 being omitted. The outer drum surface of the quick release element 60 is encircled by several turns of a coiled band spring 172, the coils of which have a normal diameter slightly greater than that of the quick release element. Consequently, in the normal or nonoperated position of the quick release operator mechanism 170 illustrated in FIG. 7, the mechanism 170 does not interfere with free rotation of the quick release element 60.

One end 172A of the band spring 172 is attached to an energizing spring 174 which in the illustrated embodiment comprises a resilient leaf spring attached by fasteners 176 to the housing cover 38. A lug 177 serves as a stop in the normal position of spring 174. The opposite end 172B of the band spring 172 is attached to the end of a pivot arm 178 carried by a quick release shaft 180 mounted for rotation about its axis between the back plate 36 and cover 38.

Quick release is effected by downward movement of a quick release lever 182 accessible at the front of the housing 22. Lever 182 is attached to quick release shaft 180 so that when lever 182 is moved, shaft 180 is pivoted in the clockwise direction as viewed in FIGS. 7 and 10 thereby to lift the pivot arm 178 and pull upon the band spring 172.

Quick release operation is illustrated in FIG. 10. The energizing spring 174 applies to the end 172A of the band spring a force which increases in dependence upon the amount of deformation of the energizing spring 172. As the opposite band spring end 172B is pulled by the pivot arm 178, the spring engages and tightens about the outer drum surface of the quick release element 60. The multiple turns energized by the spring 174 result in a large available drive torque for rotating element 60. The quick release element 60 is firmly grasped and rotated even if oil or other lubricants are present because the use of multiple turns provides sufficient operating torque despite reduced friction.

A cam member 184 is also mounted upon the quick release shaft 180 for control of the pawl 156 and the pivot plate 152. As illustrated in FIG. 10, the cam engages an extension 186 of the pivot plate 152 to assure that during quick release the pawl release structure 150 is not operated. The cam 184 also engages the pawl 156 to maintain the pawl in engagement with the ratchet gear 86 to the end that the control drum 80 remains stationary during quick release operation.

Having reference now to FIGS. 12–16 of the accompanying drawings, there is illustrated a railroad hand brake designated as a whole by the reference numeral 200 and constructed in accordance with the principles of the present invention. In general, the brake 200 includes a housing 202 adapted to be supported on a railroad car and from which descends a chain 204 adapted to be connected to the brake rigging of the railroad car for brake application when the chain is raised and the brake release when the chain is lowered. Raising and lowering of chain 204 is effected by rotation of an input shaft 206 adapted to support a hand wheel (not shown). Quick release of the brakes may be effected by manual lifting of a quick release lever 208 accessible at the front of the housing 202.

In accordance with important features of the present invention, the hand brake 200 is provided with a spring clutch assembly generally designated as 210 and a planetary gear assembly generally designated as 212 interposed between the input shaft 206 and a chain drum 214 upon which the chain 204 may be wound. The spring clutch assembly 210 permits the chain load or brake application force to be applied, maintained in applied condition and to be gradually or abruptly released with the application of small operating or input forces and with little wear.

Proceeding now to a more detailed description of the construction of the hand brake 200, the housing 202 includes a back plate 216 and a cover 218 between which is defined an internal cavity containing the spring clutch assembly 210 and the planetary gear assembly 212. Housing 202 also includes a ratchet cover 220 carried by the housing cover 218 and a quick release cover 222 carried by the back plate 216. Mounting holes 224 are provided for attaching the housing 202 to the structure of a railroad car.

An extremely compact arrangement is provided through the use of the planetary gear assembly 212. The chain drum 214 includes an internal recess 226 wherein the spring clutch assembly 210 is received. The chain drum 214 is mounted for rotation between an inner bushing 228 supported by back plate 216 and an outer bushing 230 carried by cover 218. The chain 204 is attached to the chain drum 214 by a pin 232, and is adapted to be wound upon the periphery of the drum is response to rotation of the drum.

Planetary gear assembly 212 includes a central pinion gear 234 drivingly engaged with the large diameter gear portions 236A of a number of compound gears 236. Each compound gear 236 is mounted for rotation in the chain drum 214 by a gear shaft 238. Small diameter portions 236B of the compound gears 236 engage a fixed ring gear 240 attached to the housing back plate 216.

Figures 12, 13, 14, 15, 16:
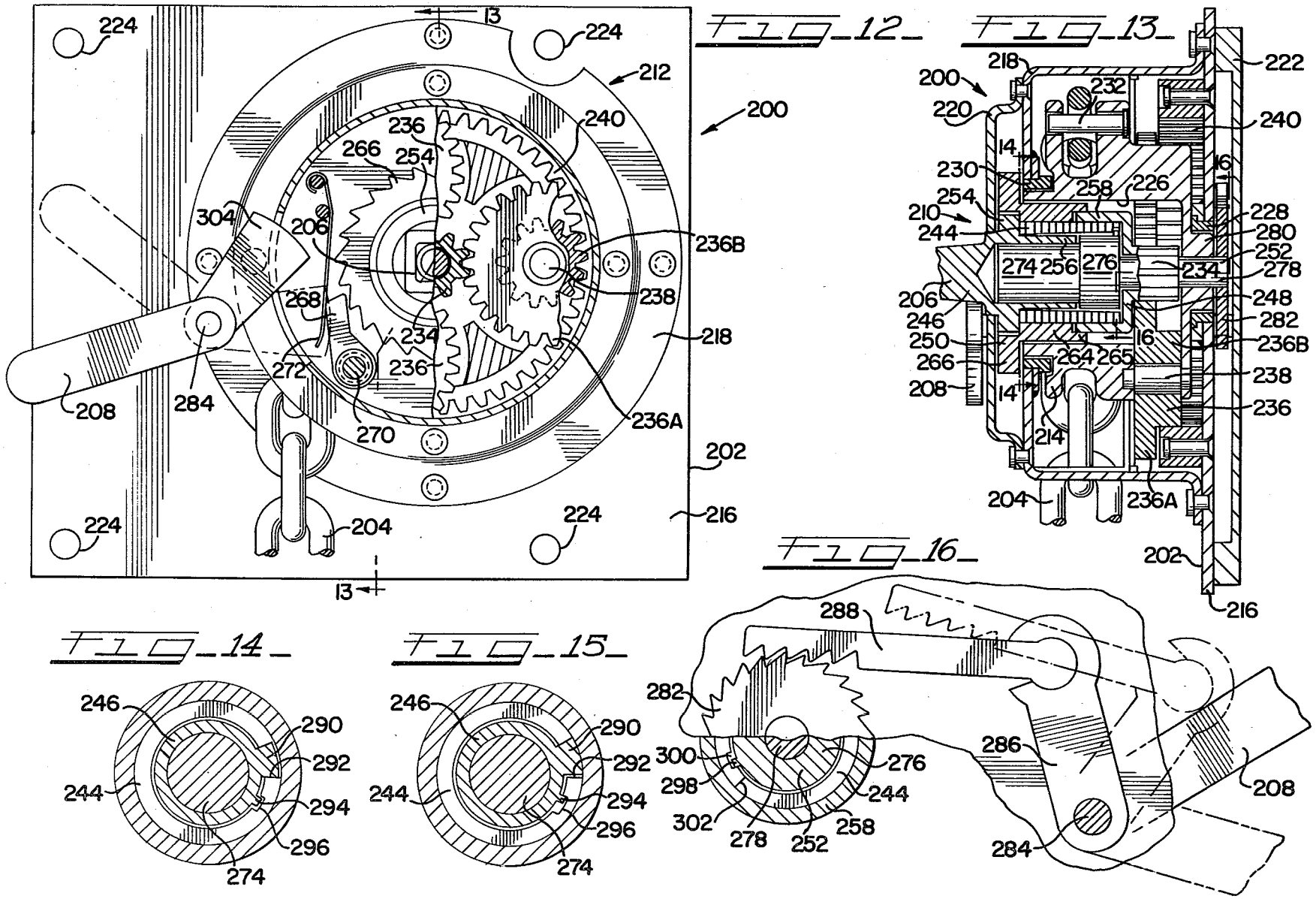
FIG. 12 is a front view, with portions shown in section, of a railroad hand brake comprising another alternative embodiment of the present invention.
FIG. 13 is a sectional view taken along the line 13—13 of FIG. 12.
FIG. 14 is a sectional view taken along the line 14—14 of FIG. 13.
FIG. 15 is a view similar to FIG. 14 illustrating the components of the device in a different position.
FIG. 16 is a fragmentary sectional view on an enlarged scale taken along the line 16—16 of FIG. 13.

Rotation of the pinion gear 234 in a clockwise direction as viewed in FIG. 12 is effective through the agency of the compound gears 236 and ring gear 240 to rotate the chain drum 214 in the direction for taking up the chain 204 and applying the brakes. This direction of rotation is referred to in this description as the forward direction. Conversely, rotation of pinion gear 234 in the opposite or reverse direction corresponds to rotation of the chain drum 214 in the direction for unwinding the chain 204 and release of the brakes.

The spring clutch assembly 210 provided in accordance with the present invention includes a coiled clutch spring 244 associated with an input element 246, an output element 248, a control element 250 and a quick release element 252. The assembly 210 functions in novel fashion to control the take up and release of the load or chain 204 under the control of the rotation of the hand wheel operated input shaft 206 and movement of the quick release lever 208.

More specifically, the input element 246 includes the shaft 206 and further includes a flange portion 254 adjacent the other turn of the clutch spring 244. A sleeve shaft portion 256 extends within the clutch spring 244.

Output element 248 includes a cylindrical internal drum portion 258 surrounding approximately the inner half of the clutch spring 244 interconnected by a radial flange with the pinion gear 234. The pinion gear 234 surrounds a central axial opening of the output element 248.

The control element 250 includes a cylindrical internal drum portion 264 surrounding approximately the outer half of the clutch spring 244 and aligned with the output drum 258. Alignment may be maintained by a shoulder 265 of the control element 250 surrounding the outer end of the output element 248. A ratchet gear 266 is formed on the control element 250 and is received between the cover 218 and the ratchet cover 220. In order to limit rotation of the control element 250 to the forward direction and prevent movement in the reverse direction, a pawl 268 (FIG. 12) is engageable with the ratchet gear 266. Pawl 268 is pivotally mounted upon a pin 270 and is urged into engagement with ratchet gear 266 by a pawl spring 272.

The output and control drums 258 and 264 are aligned with one another and rotatable about a common axis of rotation. The drums lie in a common surface of rotation, preferably a right circular cylindrical surface as illustrated. The clutch spring 244 is telescoped with these two drum surfaces for selective engagement therewith. The clutch spring may have a relaxed diameter slightly larger than that of the drums 258 and 264 and defines therewith a normally energized, expanding spring clutch.

The quick release element 252 comprises an elongated shaft having an outer end portion 274 rotatably received within the sleeve 256 of the input element 246. An intermediate shaft portion 276 has a diameter corresponding to that of the sleeve 256 and underlies the inner portion of the clutch spring 244. An inner end portion 278 of the control element 250 extends through the pinion gear 234, through a hub portion 280 of the chain drum 214 and into the region enclosed by the quick release cover 222. A quick release gear 282 is fastened to the innermost end of the shaft portion 278 (FIG. 16).

Rotation of the quick release element 252 in the forward direction is effected by upward pivoting of the quick release lever 208. Lever 208 is attached to a shaft 284 mounted for limited rotation and extending into the region within the quick release cover 222. A pivot arm 286 is carried by the shaft 284 and in turn supports for limited rotation a quick release arm 288 having ratchet teeth engageable with the quick release gear 282. When the arm 288 is moved by manipulation of the lever 208 from the position shown in broken lines in FIG. 16 to the position shown in full lines in FIG. 16, the quick release gear 282 and consequently the quick release element 252 is rotated through a limited distance in the forward direction.

When it is desired to apply the brakes by winding the chain 204 upon the chain drum 214, the input shaft 206 is rotated in the forward direction. Through the agency of the spring clutch assembly 210, this results in forward rotation of the pinion 234, operation of the planetary gear assembly 212, and rotation of the chain drum 214 in the direction for taking up the chain 204.

More specifically, the input element 246 includes a drive element in the form of a projection 290 (FIGS. 14 and 15) engageable with an outer radial end 292 of the clutch spring 244. When the input element 246 is rotated in the forward direction, the projection 290 engages the spring end 292 as shown in FIG. 14 and causes the clutch spring 244 to tend to expand into driving engagement with the control drum 264 and the output drum 258. Consequently, the control element 250 and the output element 248 are locked together by the clutch spring 244 and rotate with the input element 246 in the forward direction in a substantially unitary fashion.

During rotation of the drum members 258 and 264, the ratchet gear 266 also rotates in the forward direction. Rotation in this direction is permitted by the pawl 268.

When the brakes have been applied by winding the chain 204 against the brake load to a desired extent, the hand wheel is released and the brakes remain locked. The control element 250 is held against rotation in the reverse direction by engagement of the pawl 268 with the ratchet gear 266. The chain tension or brake load force acts on the pinion 234 through the agency of the planetary gear assembly 212 urging the pinion 234 and the output drum 258 to rotate in the reverse direction. As a result, the clutch spring 244 is maintained in its energized condition in firm locking engagement with the output and control drums 258 and 264. Since the pinion 234 is therefore prevented from rotating in reverse direction, the brakes are maintained in the applied condition.

In order gradually to release the brakes by permitting unwinding of the chain 204, the input shaft 206 is turned in the reverse direction. The input element 246 includes a second drive element in the form of a projection 294 (FIGS. 14 and 15) loosely received in an aligned notch 296 in the clutch spring 244 adjacent its outer end 292. As input element 246 is rotated in the reverse direction, the projection 294 in the notch 296 pulls upon the spring 244 causing the spring 244 to tend to radially contract and to separate itself from the surfaces of the control drum 264 and the output drum 258.

The result of this radial contraction or deenergization is to permit the pinion 234 gradually to rotate in the reverse direction under the influence of the applied load. Radial contraction or deenergization of the spring due to the drive projection 294 is effective starting at the outer end 292 of the spring and moving toward its opposite end. As the spring 244 becomes disengaged from the control drum 264, the output drum 258 moves in the reverse direction tending once again to tighten the spring. In this manner, the output drum 258 is able through clutching action of the spring 244 to follow the rotational reverse movement of the input element 246 while the control element 250 remains stationary.

In some instances it is desirable to release the brake forces or load quickly rather than in a gradual or modulated fashion. In order to effect this load dump or quick release operation, the quick release lever 208 is operated to rotate the quick release element 252 in the forward direction. As illustrated in FIG. 16, the quick release element 252 is provided with a drive element in the form of a projection 298 loosely received in a notch 300 formed in the clutch spring 244 adjacent its innermost end 302. As the quick release element 252 is rotated, the projection 298 pulls upon the spring end 302 causing the innermost portion of the spring 244 to tend to radially contract or become disengaged. As a result, the output drum 258 is freed from the stationary control drum 264 and is capable of rotation independently thereof. Consequently, the chain 204 is free to descend under the influence of the applied load. This quick release is accomplished while the input element 246 and hand wheel associated therewith remain stationary.

An important advantage of the spring clutch assembly 210 is that the forces required for release of applied loads are relatively small. Even if the brake load is large, such as may result from over-torquing or from manual application of the brakes when already operated pneumatically, nevertheless the force required for gradual release or for quick release of the brakes is only that necessary for radial contraction or deenergization of the clutch spring 244. Since large operating forces are not required to effect load release, wear of the clutch surfaces is avoided.

The projections 294 and 298 received respectively in notches 296 and 300 adjacent the opposite ends of the springs perform an additional function of maintaining the desired orientation of the spring 244 relative to the input element 246 and the quick release element 252. Consequently, at any time that a load is present, operation of the quick release lever 208 acts to deenergize the inner segment of the spring 244. To assure that the control element 250 remains stationary during quick release, a cam 304 is carried on the quick release shaft 284 for holding the pawl 268 in engagement with the ratchet gear 266 during quick release operation.

In order to obtain reliable clutch operation, it is preferred that the clutch spring 244 be uniformly tapered throughout its length with the turns at the outer end having a thickness slightly larger than those at the inner end. The taper is illustrated in exaggerated fashion in FIG. 13. It is believed that this construction permits reliable radial deformation of the spring turns during quick release and during gradual release by assuring orderly progressive contraction or deenergization of the turns of the spring. It is also believed that this construction avoids inconsistent operation and chatter during gradual release. An additional advantage of the clutch spring assembly 210 is that the clutch spring 244 is captured between the surfaces of drums 258 and 264 and the outer surfaces of the input element sleeve portion 256 and quick release element segment 276. In this manner the nonworking surface of the spring 244 is supported against excessive radial deformation.

In the preceding description and following claims, the action of the clutch spring is sometimes defined as a radial deformation. Use of the terms radial deformation, radial contraction or radial expansion is not intended to exclude configurations such as self-energized spring clutch wherein the deformation is so slight as not to be visible or measurable.

While the invention has been described with reference to details of the illustrated embodiments, it should be understood that such details are not intended to limit the scope of the present invention as defined in the following claims.

What is claimed and desired to be secured by Letters Patent of the United States is:

1. A load take up device of the type incorporating a spring clutch, and comprising in combination:

a housing;

an output drum having a cylindrical surface;

coupling means for interconnecting the output drum with the load;

a control drum having a cylindrical surface adjacent to and aligned with said output drum;

said output and control drums being mounted for rotation relative to said housing about a common axis;

rotation controlling means connected between the housing and the control drum and permitting rotation of the control drum in only one rotational direction;

a coil spring telescoped with said output and control drums, said spring being radially deformable in a first direction to engage said output and control drums and being radially deformable in a second direction to release said output and control drums;

an input element engageable with said spring at a region adjacent said control drum and remote from said output drum and movable in opposed rotational directions selectively to radially deform said spring in said first direction to interlock said input element and said control and output drums for rotation thereof in said one rotational direction for load take up, and to radially deform said spring in said second direction to release said output drum from said control drum to permit gradual movement of said output drum in the opposite rotational direction for gradual release of the load; and a quick release element engageable with said spring at a region said output drum and remote from said control drum, said quick release element being movable to radially deform said spring in said second direction abruptly to uncouple said output drum from said control drum for unrestricted release of the load.

2. The device of claim 1, said input element being rotatable about said common axis and including drive structure for selectively pushing and pulling said spring in a tangential direction.

3. The device of claim 2, said drive structure including an input drum having a cylindrical surface aligned with said control and output drums, said spring being in normal frictional engagement with said input, control and output drums.

4. The device of claim 3, said drive structure further including abutment means engageable with said spring for radially deforming said spring in said second direction.

5. The device of claim 2, said drive structure including projection means engageable with said spring for radially deforming said spring in said first and second directions.

6. The device of claim 5, said projection means comprising a first projection engageable with an end of the spring and a second projection engageable with a notch in the spring.

7. The device of claim 1, said rotation controlling means including a ratchet and a pawl.

8. The device of claim 7 further comprising means coupled between said pawl and said quick release element for holding said pawl in engagement with said ratchet during operation of said quick release element.

9. The device of claim 1, said spring surrounding said control and output drums.

10. The device of claim 1, said control and output drums surrounding said spring.

11. The device of claim 1, said spring being in normal frictional engagement with said output and control drums.

12. The device of claim 1, said coupling means comprising a pinion gear connected to said output drum and a drive gear coupled to the load and meshed with said pinion gear.

13. The device of claim 1, said coupling means comprising a planetary gear drive connected to said output drum and coupled to the load.

14. The device of claim 1, said spring having a tapered wall thickness throughout its length, and being thickest adjacent said input element.

15. A spring clutch load take up device comprising:

first and second drum members disposed in stacked relationship in a first generally cylindrical surface;

a clutch spring interfacing and engageable with said first and second surfaces;

said drums being rotatable about a common axis, a bidirectionally rotatable input element engageable with said spring adjacent said first drum member;

means for permitting said first drum to rotate in only one direction;

means for coupling said second drum to a bidirectionally rotatable load element; and release means engageable with said spring adjacent said second drum for disengaging said spring from the second drum.

16. The device of claim 15 wherein said spring wall thickness is tapered and is thinnest adjacent said second drum.

17. A spring clutch load take up device comprising:

first, second and third drum members disposed in stacked relationship in a first generally cylindrical surface;

a clutch spring interfacing and engageable with said first, second and third surfaces;

all of said drums being rotatable about a common axis, means for coupling said first drum to a source of bidirectional rotational input force;

means for permitting said second drum to rotate in only one direction;

means for coupling said third drum to a bidirectionally rotatable load element; and release means engageable with said spring adjacent said third drum for disengaging said spring from the third drum.

18. A spring clutch load take up device comprising:

first, second and third drum members disposed in stacked relationship in a first generally cylindrical surface;

a fourth drum member in a second generally cylindrical surface concentric with and spaced from said first surface;

a clutch spring between said surfaces engageable with said first, second and third surfaces;

all of said drums being rotatable about a common axis, means for coupling said first drum to a source of bidirectional rotational input force;

means for permitting said second drum to rotate in only a first direction;

means for coupling said third drum to a bidirectionally rotatable load element;

means for rotating said fourth drum in said first direction; and release means on said fourth drum engageable with said spring upon rotation of said fourth drum in said first direction for disengaging said spring from the third drum.

19. The device of claim 18, said spring being normally engaged with said first, second and third drums and being energized for driving engagement with said first, second and third drums in response to rotation of said first drum in said first direction.

20. The device of claim 19, said input drum including a drive element engageable with said spring for deenergizing said spring in response to rotation of said spring in a second direction.

21. The device of claim 20 further including a unidirectional drive connection between said fourth drum and said third drum for permitting back drive of said third drum in response to engagement of said spring with said third drum during rotation of said first drum in said second direction.

22. The device of claim 18, said means for rotating said fourth drum including gear teeth on said fourth drum and a toothed operator arm movable into engagement with said gear teeth.

23. The device of claim 18, said means for rotating said fourth drum including a band spring with multiple turns encircling said fourth drum, an energizing spring connected to one end of said band spring, and a movable operator connected to the other end of said band spring.

24. A railroad hand brake comprising a housing, a hand wheel and a quick release lever on said housing, a rotatable chain drum, a gear drive connected to said chain drum; a spring clutch connected between said hand wheel and said gear drive, said spring clutch including a clutch spring drivingly engageable with an output drum and a control drum, said output drum being connected to said gear drive, rotation controlling means connected to said control drum permitting rotation thereof in only a forward direction for brake application, an input member connected to said hand wheel for energizing and deenergizing said spring in response respectively to forward and reverse hand wheel rotation, and a quick release element connected between said lever and said spring for deenerigizing said spring in response to movement of said lever.

25. The railroad hand brake of claim 24, said gear drive including a pinion connected to said output drum.

26. The railroad hand brake of claim 25, said pinion engaging a drive gear connected to said chain drum.

27. The railroad hand brake of claim 25, said pinion engaging a plurality of planetary gears supported by said chain drum.

* * * * *